US007080492B1

(12) United States Patent
Guiller

(10) Patent No.: US 7,080,492 B1
(45) Date of Patent: Jul. 25, 2006

(54) CHANNEL JOINT STRUCTURAL SYSTEM

(76) Inventor: Armando Guiller, 2507 Palisade Ave., Union City, NJ (US) 07087

( * ) Notice: Subject to any disclaimer, the term of this patent is extended or adjusted under 35 U.S.C. 154(b) by 391 days.

(21) Appl. No.: 10/649,384

(22) Filed: Aug. 27, 2003

Related U.S. Application Data

(60) Provisional application No. 60/406,778, filed on Aug. 29, 2002.

(51) Int. Cl.
*E04H 12/00* (2006.01)

(52) U.S. Cl. ..... 52/653.2; 52/712; 182/186.4

(58) Field of Classification Search ..... 52/653.2, 52/655.1, 700, 712; 446/123, 124, 115, 85, 446/109–114, 120–122; 182/186.4, 186.5, 182/186.3
See application file for complete search history.

(56) References Cited

U.S. PATENT DOCUMENTS 2,589,952 A * 3/1952 Mercier ..... 446/123
3,197,822 A * 8/1965 Herrschaft ..... 403/387
3,989,226 A * 11/1976 Burgess ..... 256/65.04
4,665,838 A * 5/1987 Minshall ..... 108/186
5,904,022 A * 5/1999 Zadok ..... 52/650.1
6,039,192 A * 3/2000 Hollander ..... 211/186
6,279,288 B1 * 8/2001 Keil ..... 52/653.2

* cited by examiner

*Primary Examiner*—Naoko Slack
(74) *Attorney, Agent, or Firm*—Richard A. Joel, Esq.

(57) ABSTRACT

A modular channel joint structural system comprising an interlocking system with matching extensions. The extensions slide into matching grooves or channels and are bottled together with only one bolt per joint. In a typical embodiment, aligned members with transverse grooves towards the ends thereof are joined together and to a third perpendicular member with inwardly curved extensions which engage the grooves. The third member includes a corresponding aperture on both sides thereof which is positioned in line with an end notch in the aligned members. A bolt engages the apertures to hold the three members fixedly together.

6 Claims, 4 Drawing Sheets

CHANNEL JOINT STRUCTURAL SYSTEM

CROSS REFERENCE TO RELATED APPLICATIONS

This application is based on Provisional Application Ser. No. 60/406,778 filed Aug. 29, 2002.

BACKGROUND OF INVENTION

A modular structural system which employs channel joints which are easy to assemble, light weight and capable of multiple configurations.

Typically prior systems weld all the joints to form a structure. As a result, the systems are difficult to ship and lack the flexibility to be adjusted to different spaces.

The prior art includes U.S. Pat. No. 4,063,422 to Morier which discloses a connector structure including a first connector structure for securement to the end of a post-like structure and a second connector element for securement to a further structure. Composite structural building panels and connection systems are shown in U.S. Pat. No. 6,314,704 to Bryant.

Other patents of general interest include U.S. Pat. Nos. 6,591,547; 6,405,507; and 5,536,457. None of the foregoing patents disclose a modular structural system similar to the present invention.

SUMMARY OF INVENTION

This invention relates to a modular channel joint structural system which offers rigidity and lightweight as well as ease of assembly. Instead of adding elements as squares and hardware to obtain a rigid joint, the present invention creates an interlocking system with matching extensions which slide into matching grooves or channels and are bolted together with only one bolt per joint. In a typical embodiment, aligned members with transverse grooves towards the ends thereof are joined together and to a third perpendicular member with inwardly curved extensions which engage the grooves. The third member includes a corresponding aperture on both sides thereof which is positioned in line with an end notch in the aligned members. A bolt engages the apertures to hold the three members fixedly together.

Accordingly, an object of this invention is to provide a new and improved channel joint structural system.

Another object of this invention is to provide a new and improved lightweight module structural system.

A further object of this invention is to provide a new and improved channel joint structural system which includes members having channels engaged by downwardly extending end portions on another member to form a rigid joint.

A more specific object of this invention is to provide a new and improved modular joint structural system employing channel portions which are engaged by adjacent member portions and simply bolted together.

BRIEF DESCRIPTION OF DRAWINGS

The above and other objects of the invention may be more readily seen when viewing in conjunction with the accompanying drawings wherein.

DETAILED DESCRIPTION

Figure 1B:
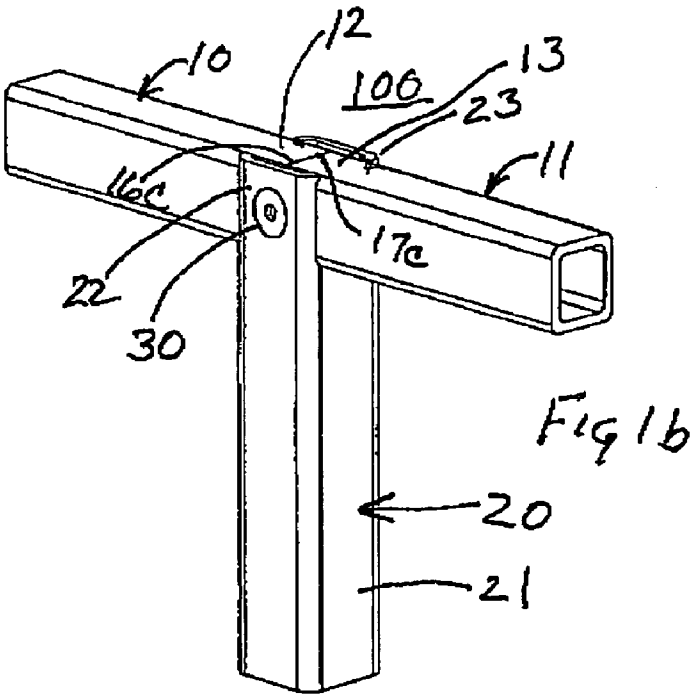
FIG. 1*b* is a perspective view of the invention in an assembled state.
Figure 1A:
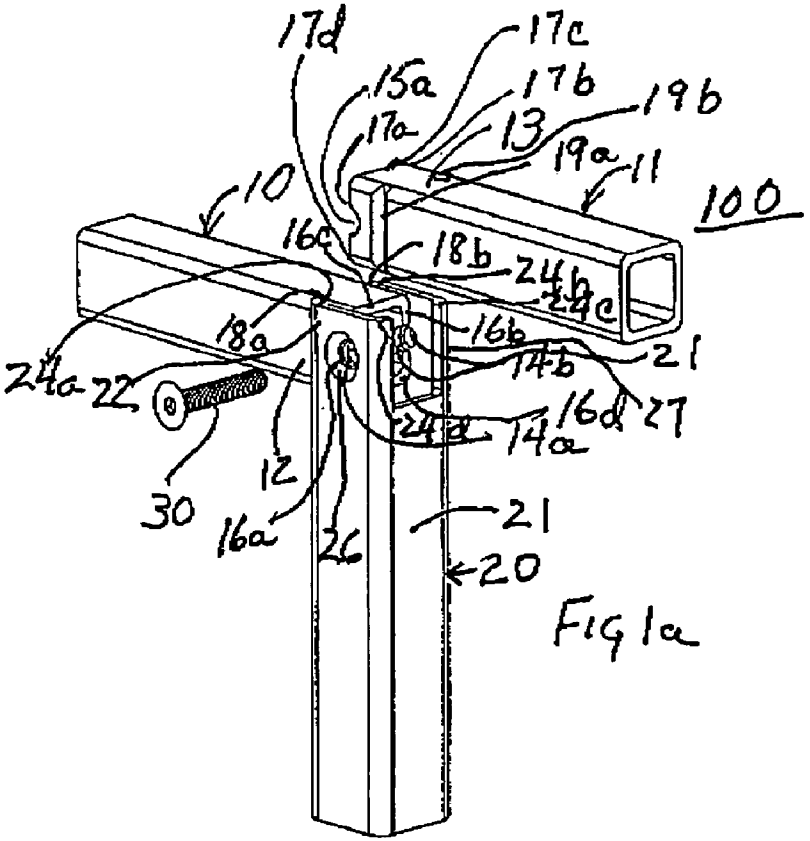
FIG. 1*a* is an exploded perspective view or the channel joint structural system comprising the invention.
Figure 1C:
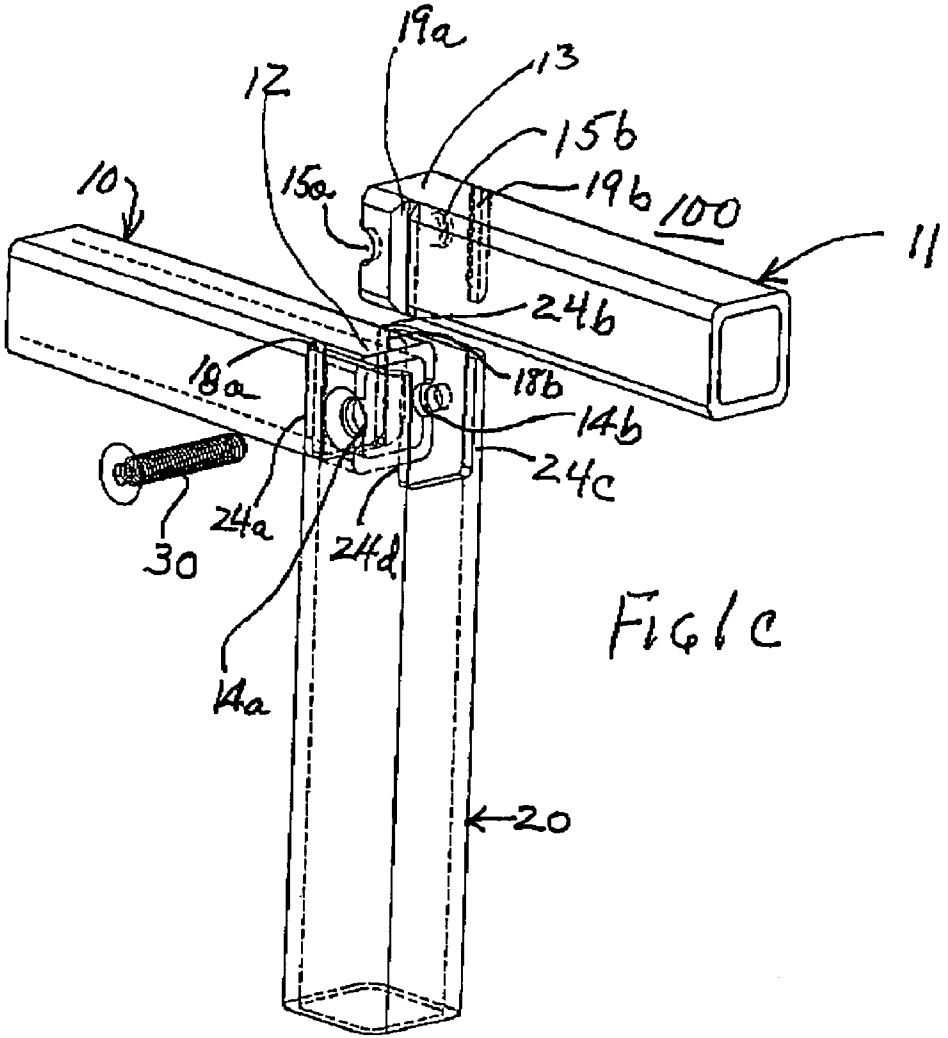
FIG. 1*c* is a view of FIG. 1 with elements shown in phantom.

Referring now to FIG. 1 of the drawings, the invention 100 comprises channel members 10 and 11 having mating ends 12 and 13 which each include a corresponding semicircular recess 14*a*, 14*b* and 15*a*, 15*b* in opposite portions 16*a*, 16*b* and 17*a*, 17*b* of a substantially rectangular races 16*a–d* and 17*a–d*. Spaced a predetermined distance from the faces 16*a*, 16*b* and 17*a*, 17*b* are slots 18*a*, 18*b* and 19*a*, 19*b* which run parallel to the faces 16*a*, 16*b* and 17*a*, 17*b*.

A third member 20 includes a main body portion 21 of substantially rectangular hollow configuration and opposite projecting end portions 22 and 23. The end portion 22 includes inwardly extending edges 24*a–d* which engage the slots 18, 18*b*, 19*a* and 19*b*, respectively. Third member 20 also includes opposing threaded apertures 26 and 27 which are located in line with recesses 14*a*, 14*b* and 15*a*, 15*b*. When the slots 18*a*, 18*b*, 19*a* and 19*b* are engaged by the edges 24*a–d*, the semicircular recesses 14*a* and 15*a* form circular apertures adjacent and in line with the aperture 26. Similarly, the recess 14*b* and 19*b* form a circular aperture adjacent and in line with aperture 27. A threaded bolt 30 then engages the countersunk apertures 26 and 27 as well as the recesses 14*a*, 15*a*, and 14*b*, 15*b* to securely fasten the members 10, 11 and 20 together. While elongated straight members 10, 11 and 20 are shown in FIG. 1, the members may have other configurations apart from the join portion described above.

Figure 2:
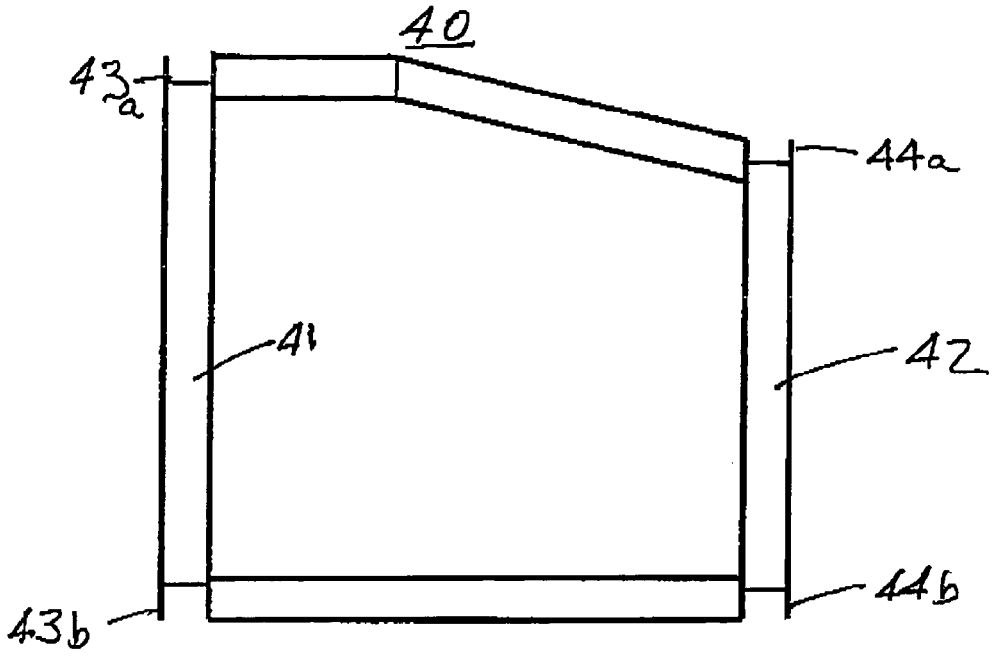
FIG. 2 is an end view of a modular component of the structure of FIG. 3; and, FIG. 3 is a perspective view of a modular structure employing the novel joint of the invention.
Figure 3:
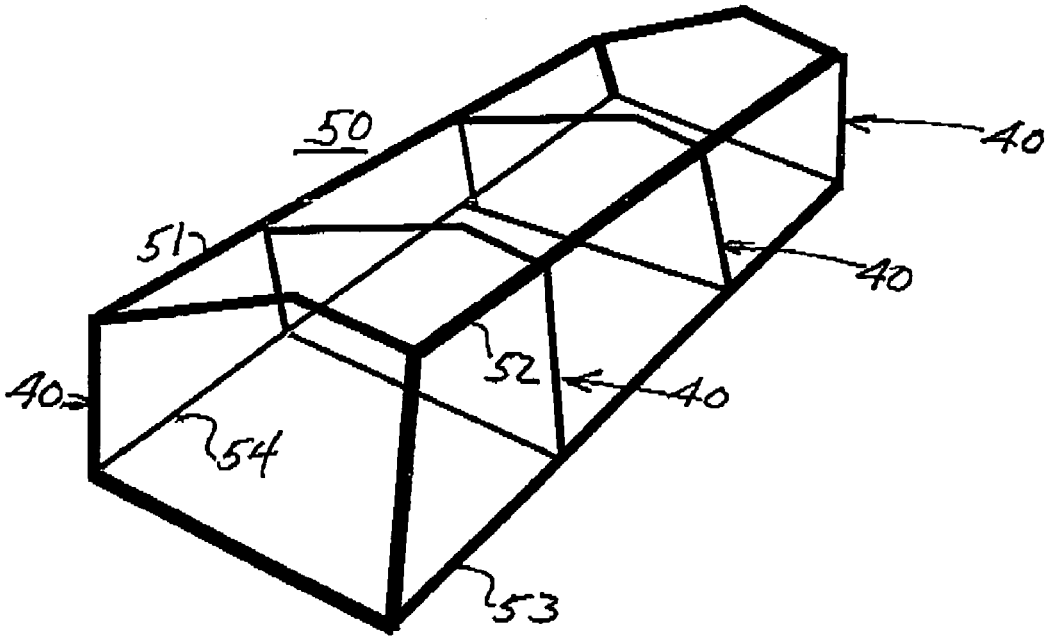

FIG. 2 depicts and end view of a modular structure component 40 using the joint design proposed herein. The structure 40 includes members 41 and 42 which correspond at their ends 43*a*, 43*b* and 44*a*, 44*b* to the end portion 22 shown in FIG. 1. The members 46 and 47 are welded to the respective end portion. The final modular structure 50 is shown in FIG. 3 and comprises a plurality of end structural portions 40 joined by members 51, 52, 53 and 54.

While the invention has been explained by a detailed description of certain specific embodiments, it is understood that various modifications and substitutions can be made in any of them within the scope of the appended claims, which are intended also to include equivalents of such embodiments.

The invention claimed is:

1. A modular channel joint structural system comprising:

a first elongated hollow member having a substantially rectangular cross-section with four sides including at least one end portion having aligned recesses on two opposite sides, said sides including corresponding transverse slots on said sides spaced a predetermined distance from the end thereof;

a second elongated hollow member having a substantially rectangular cross-section with four sides including at least one end portion having aligned recesses on two opposite sides, said sides including corresponding transverse slots on said sides spaced a predetermined from the end thereof;

a third elongated hollow member having a substantially rectangular cross-section and two outwardly extending opposite sides, said sides each having opposing apertures and protruding ends which engage the slots in the first and second members to hold said members in engagement; and, a bolt engaging said apertures in the third member and the recesses in the first and second member to secure said members.

2. A modular channel joint system in accordance with claim 1 wherein:

the first, second and third embers each include a second and portion having the same design as the first end portion.

3. A modular channel joint system in accordance with claim 1 wherein:

the first elongated hollow member includes an intermediate portion having a predetermined bend in said member.

4. A modular channel joint system in accordance with claim 3 wherein:

the second elongated hollow member includes an intermediate portion having a predetermined bend in said member.

5. A modular channel joint system in accordance with claim 4 wherein:

the third elongated hollow member includes an intermediate portion having a predetermined bend in said member.

6. A modular channel joint system in accordance with claim 1 further including:

a plurality of members similar to the first, second and third members coupled to a plurality of other members to form a modular structure.

* * * * *